US007185951B2

(12) United States Patent
Johnson et al.

(10) Patent No.: US 7,185,951 B2
(45) Date of Patent: Mar. 6, 2007

(54) CHAIR AND SYNCHROTILT CHAIR MECHANISM

(75) Inventors: LeRoy Johnson, Lowell, MI (US); Philip Crossman, Omena, MI (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 10/730,625

(22) Filed: Dec. 8, 2003

(65) Prior Publication Data

US 2004/0155502 A1 Aug. 12, 2004

Related U.S. Application Data

(62) Division of application No. 10/325,355, filed on Dec. 19, 2002, now Pat. No. 6,685,267.

(51) Int. Cl.
*A47C 1/031* (2006.01)

(52) U.S. Cl. ..... 297/343; 297/300.2; 297/301.1; 297/317

(58) Field of Classification Search ..... 297/317–318, 297/320, 322, 323, 325, 300.4, 343, 337, 297/316, 300.2
See application file for complete search history.

(56) References Cited

U.S. PATENT DOCUMENTS 2,304,199 A 12/1942 Pinnow
4,277,102 A * 7/1981 Aaras et al. ..... 297/411.36
4,790,600 A 12/1988 Behringer
4,861,108 A 8/1989 Acton et al.
5,009,467 A * 4/1991 McCoy ..... 297/411.36
5,190,349 A 3/1993 Auston et al.
5,405,188 A 4/1995 Hanson
5,582,460 A * 12/1996 Schultz ..... 297/353

(Continued)

FOREIGN PATENT DOCUMENTS

DE 3834614 A1 4/1990

(Continued)

*Primary Examiner*—Peter R. Brown
(74) *Attorney, Agent, or Firm*—Shook, Hardy & Bacon

(57) ABSTRACT

A synchrotilt chair mechanism and a chair are provided. The synchrotilt chair mechanism is for use on a chair that has a base assembly with an extending pedestal, a seat and a back. The mechanism includes a chassis that is coupled to the pedestal and a seat plate that is coupled to the chassis and to the chair seat. The seat plate can slide relative to the chassis. The mechanism further includes a back support bar that is coupled on one end to the chassis. The support bar extends upwardly from the chassis. A pair of arm supports are further included that can be coupled to the chair. Each arm support extends upwardly adjacent one side of the chair seat. The mechanism further includes a back bracket having a pair of ends that extend adjacent a side of the chair. Each end is pivotally coupled to the adjacent arm support. The back bracket further includes a guide plate that mounts to the chair back and that has at least one guide slot. The guide slot slidably and pivotally couples the back bracket to the other end of the back support bar. During recline of the chair, the back bracket pivots about the pivot connection on each arm support and the guide plate guides the lower chair back downwardly and forwardly. In addition, during recline the chair seat slides forwardly on the chassis.

5 Claims, 3 Drawing Sheets

U.S. PATENT DOCUMENTS 5,660,439 A * 8/1997 Unwalla ..... 297/316
5,810,440 A * 9/1998 Unwalla ..... 297/316
5,871,258 A 2/1999 Battey et al.
5,909,923 A 6/1999 DeKraker
5,975,634 A 11/1999 Knoblock et al.
5,979,984 A 11/1999 DeKraker et al.
6,086,153 A 7/2000 Heidmann et al.
6,109,694 A * 8/2000 Kurtz ..... 297/320
6,116,695 A 9/2000 Heidmann et al.
6,135,556 A 10/2000 Chu et al.
6,318,800 B1 11/2001 DeKraker
6,349,992 B1 2/2002 Knoblock et al.
6,367,877 B1 4/2002 Knoblock et al.
6,523,898 B1 2/2003 Ball et al.
2002/0190555 A1 * 12/2002 Holbrook et al. ..... 297/300.4
2002/0190558 A1 12/2002 Phillips et al.

FOREIGN PATENT DOCUMENTS

JP 03023810 A 1/1991
JP 04090719 A 3/1992

* cited by examiner

CHAIR AND SYNCHROTILT CHAIR MECHANISM

CROSS-REFERENCE TO RELATED APPLICATIONS

This application is a divisional of U.S. patent application Ser. No. 10/325,355, filed Dec. 19, 2002 now U.S. Pat. No. 6,685,267, and claims priority therefrom.

STATEMENT REGARDING FEDERALLY SPONSORED RESEARCH OR DEVELOPMENT

None

TECHNICAL FIELD

This invention relates generally to chair control mechanisms, and more particularly to a mechanism that synchronizes the movement of a chair seat and backrest.

BACKGROUND OF THE INVENTION

Task chairs or office-type chairs have evolved over time to improve the support provided to chair occupants and to provide chairs that better meet the usage needs of the occupant. One improvement made in chairs, and more particularly the tilt mechanisms of chairs, is the synchronization of the back and seat to one another. On these mechanisms, the back and seat are synchronized so that as the back reclines, the seat moves as well. These synchronized mechanisms are also referred to as "synchrotilt" mechanisms. These mechanisms are usually designed so that the back moves at a greater rate than the seat.

When designing a sychrotilt mechanism, a designer considers several factors. One factor is the "shirt shear" resulting from the design. Another factor is the "bridging" resulting from the design. Shirt shear is the tendency of the chair movement to pull and/or push an occupant's shirt during recline. If shirt shear occurs, the occupant's shirt is untucked, which is undesirable. Bridging is the condition experienced when the lower back support falls away from the occupant during recline. When bridging occurs, the occupant's lumbar area is largely unsupported by the chair back. But it is desirable to provide the occupant proper lumbar support throughout the range of motion of the chair, such that the occupant has lumbar support in the upright position, the reclined position and any position in-between. The designer thus strives to minimize shirt shear and bridging.

Another factor considered by the synchrotilt-mechanism designer is the effect recline has on the occupant's center of gravity over the chair base. It is desirable to allow an occupant to fully recline while not moving the occupant's center of gravity so much that an over-balancing or tipping condition occurs. This provides the occupant with an increased sense of comfort while in the chair. Moreover, if the occupant's center of gravity is maintained centrally over the base assembly of the chair, a smaller base assembly can be used. The chair designer is thus offered increased design flexibility in choosing a base assembly.

An additional design factor is the position of the occupant's eyes relative to the work surface while the occupant is in various positions in the chair. This design factor can be called the "viewing distance" factor. It is desirable to alter the viewing distance as little as possible as the occupant moves from an upright position to a fully-reclined position.

This allows the occupant's eyes to remain approximately the same distance from a working surface in either the upright position or reclined position, without further manipulation of the chair position. For example, if an occupant is operating at a computer terminal, it is desirable to maintain the distance of the occupant's eyes relative to the computer display from the upright position through the fully-reclined position. If this is achieved, the occupant is not required to move the chair forwardly after reclining to adjust for a change in viewing distance. Similarly, it is also desirable to maintain the position of the occupant's arms and hands as much as possible from the upright position to the reclined position. If this is achieved, the occupant can continue working, such as at a keyboard, whether in the fully-upright position, the fully-reclined position, or any intermediate position.

Yet another factor considered by chair-mechanism designers is the reclining "dwell" of the chair. On most chair mechanisms, the back or seat of the chair is biased so that the chair will easily return to the upright position when the reclining force is relieved. In these chairs, the initial force needed to recline the chair is greater than the force needed to maintain the chair in the reclined position. The "dwell" is the force needed to maintain the chair in the reclined position. It is most desirable to design a mechanism easily adjusted so that the dwell force approximates the force applied by the weight of the occupant's upper body. If this is achieved, the occupant can maintain the chair in a variety of reclined positions with very little effort.

In addition, the biasing mechanism used to return the chair to the upright position from a reclined position is adjustable on many chairs. The adjustment mechanism is provided so that once adjusted a range of occupants having a range of body types can use the chair comfortably. But the biasing mechanisms are typically large springs that are difficult to adjust properly. This results in occupants using the chair in a condition that is not optimized for their particular body type. It would be desirable to provide a synchrotilt mechanism that did not rely on a large-spring-biasing mechanism to bias the chair to the upright position and that accommodated a large range of occupant body types without significant adjustment.

It would be desirable, therefore, to provide a synchrotilt mechanism for use on a chair that optimally satisfies the above design considerations and overcomes the existing drawbacks and deficiencies of prior art chairs. A synchrotilt mechanism is needed that minimizes bridging and shirt pull so that an occupant's back is properly supported during recline of the chair. Moreover, a synchrotilt mechanism is needed that maintains the viewing and reach distance while the occupant is in a reclined position in the chair and that allows the occupant to recline while maintaining the center of gravity generally over the base of the chair. Finally, a synchrotilt mechanism is needed that balances the recline dwell of the chair in a way that accommodates a wide range of occupants without significant adjustments to the chair or mechanism.

BRIEF SUMMARY OF THE INVENTION

The present invention is directed to a synchrotilt chair mechanism and a chair with the mechanism. The synchrotilt chair mechanism is for use on a chair that has a base assembly with an extending pedestal, a seat and a back. The mechanism includes a chassis that is coupled to the pedestal and a seat plate that is coupled to the chassis and to the chair seat. The seat plate can slide relative to the chassis. The mechanism further includes a back support bar that is coupled on one end to the chassis. The support bar extends upwardly from the chassis. A pair of arm supports are further included that can be coupled to the chair. Each arm support extends upwardly adjacent one side of the chair seat. The mechanism further includes a back bracket having a pair of ends that extend adjacent a side of the chair. Each end is pivotally coupled to the adjacent arm support. The back bracket further includes a guide plate that mounts to the chair back and that has at least one guide slot. The guide slot slidably and pivotally couples the back bracket to the other end of the back support bar. During recline of the chair, the back bracket pivots about the pivot connection on each arm support and the guide plate guides the lower chair back downwardly and forwardly. In addition, during recline the chair seat slides forwardly on the chassis.

Additional advantages and novel features of the invention will be set forth in the description which follows, and in part will become apparent to those skilled in the art upon examination of the following, or may be learned from practice of the invention.

BRIEF DESCRIPTION OF THE SEVERAL VIEWS OF THE DRAWINGS

The present invention is described in detail below with reference to the attached drawing figures, wherein.

DETAILED DESCRIPTION OF THE INVENTION

Figure 2:
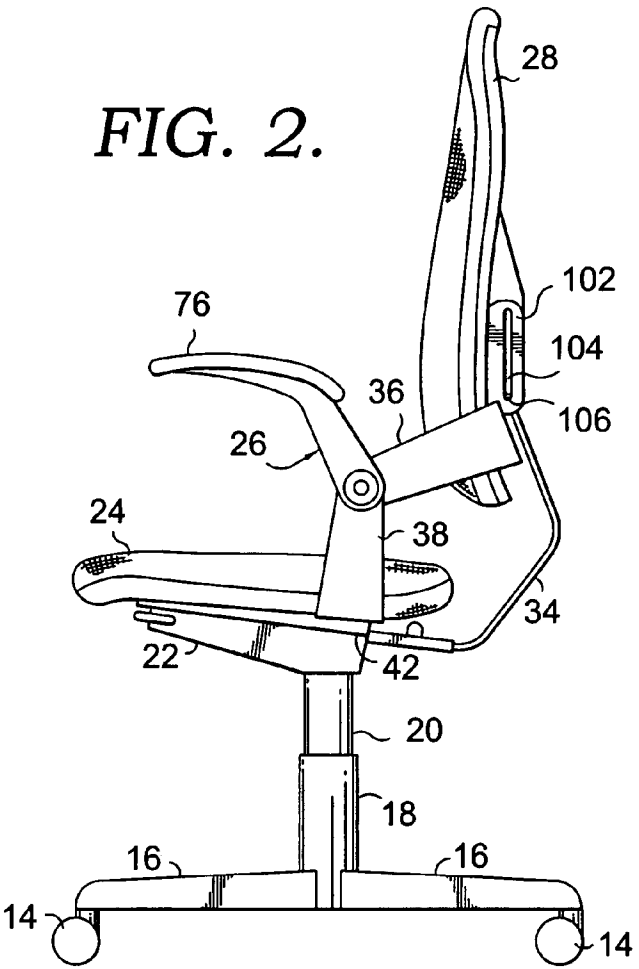
FIG. 2 is a side-elevation view of the chair of FIG. 1, shown in the fully-upright position.
Figure 1:
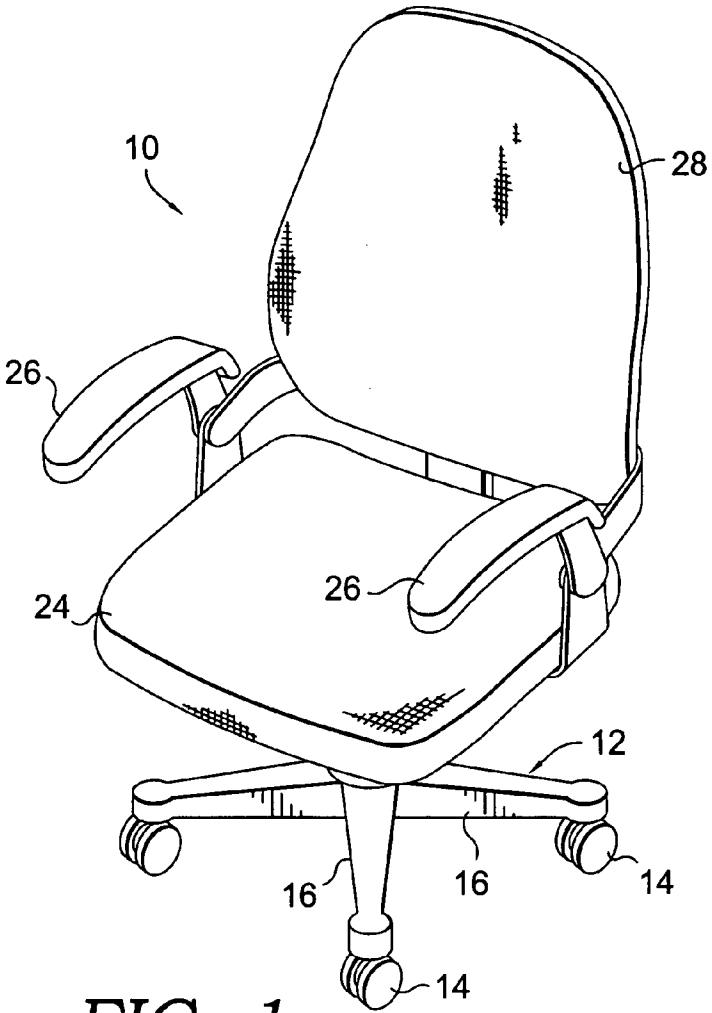
FIG. 1 is a perspective view of a chair and mechanism according to the principles of the invention.

With initial reference to FIG. 1, a chair embodying the principles of the invention is generally indicated by the reference numeral 10. Chair 10 is equipped with a base assembly 12. Base 12 preferably has a number of castors 14 operably supported on the outer ends of a corresponding number of support legs 16. Support legs 16 converge to a pedestal column 18 as best seen in FIG. 2. Preferably, pedestal column 18 and support legs 16 are integrally formed in one piece. Column 18 preferably supports a gas cylinder 20. Gas cylinder 20 allows the height of the chair to be adjusted by an occupant, as is known to those of skill in the art. The construction of the base 12 and column 18 is well-known to those of skill in the chair industry.

With continued reference to FIG. 2, a chassis 22 is coupled to gas cylinder 20. Chassis 22 supports a seat 24 that is slidingly coupled to the chassis. A pair of armrests 26 are also coupled to the seat 24, as further described below. Coupled to both the armrests and to the chassis is a chair back 28.

Figure 4:
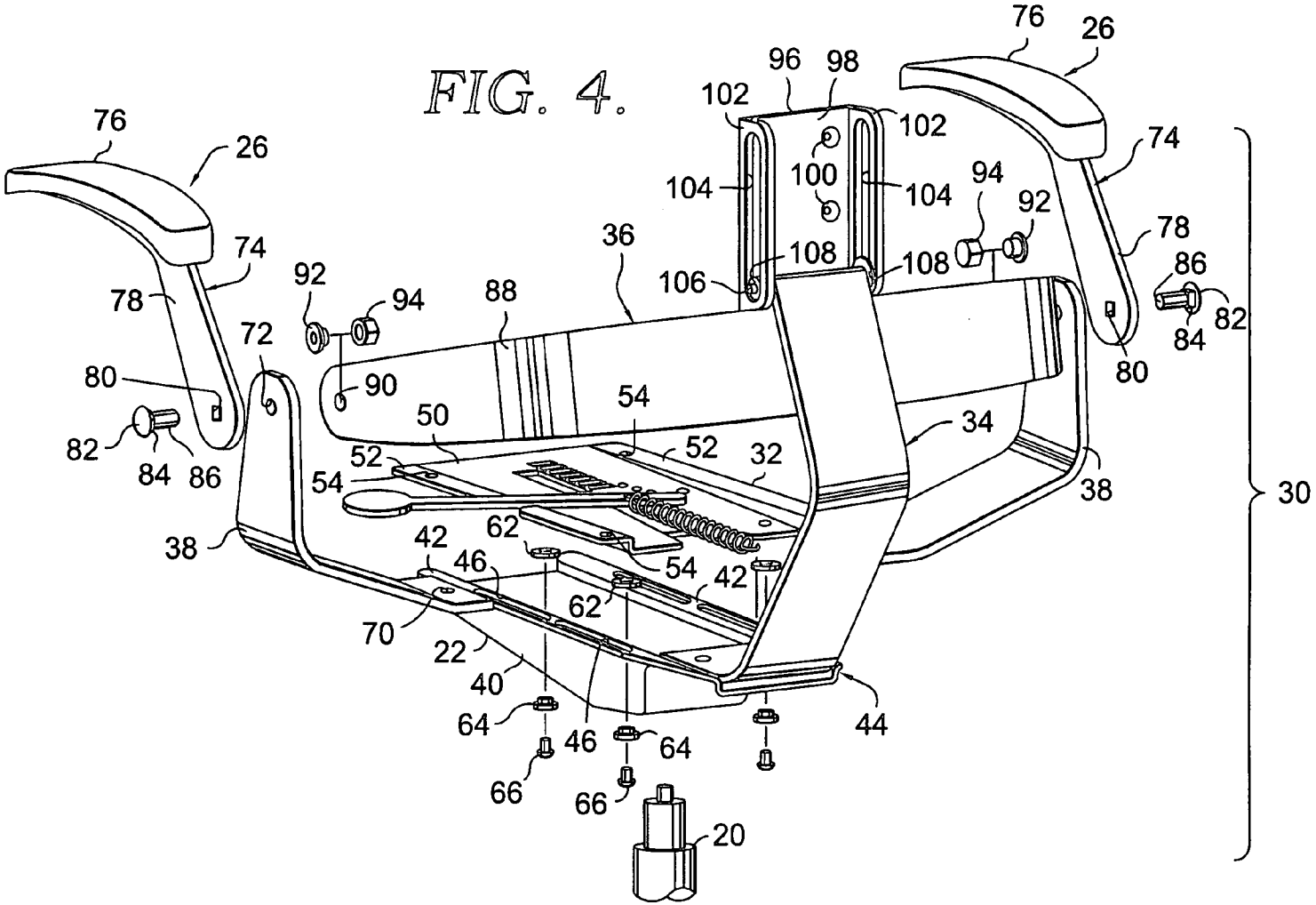
FIG. 4 is a partial view of the chair of FIG. 1, shown in exploded view to reveal construction details.

Having briefly described the basic elements of chair 10, a more detailed description of the various elements and their connection is described below. FIG. 4 shows the various components of a chair mechanism 30. Broadly stated, chair mechanism 30 includes chassis 22, a seat plate 32, a J-back support bar 34, a back bracket 36, and a pair of arms 26. Chassis 22 includes a hole in its bottom that accommodates an upper portion of gas cylinder 20. The upper portion of cylinder 20 is then secured to chassis 22 so that as the cylinder 20 extends and retracts, chassis 22 correspondingly moves up and down. Preferably, this coupling is accomplished via a tapered bushing, as is known to those of skill in the art.

Figure 5:
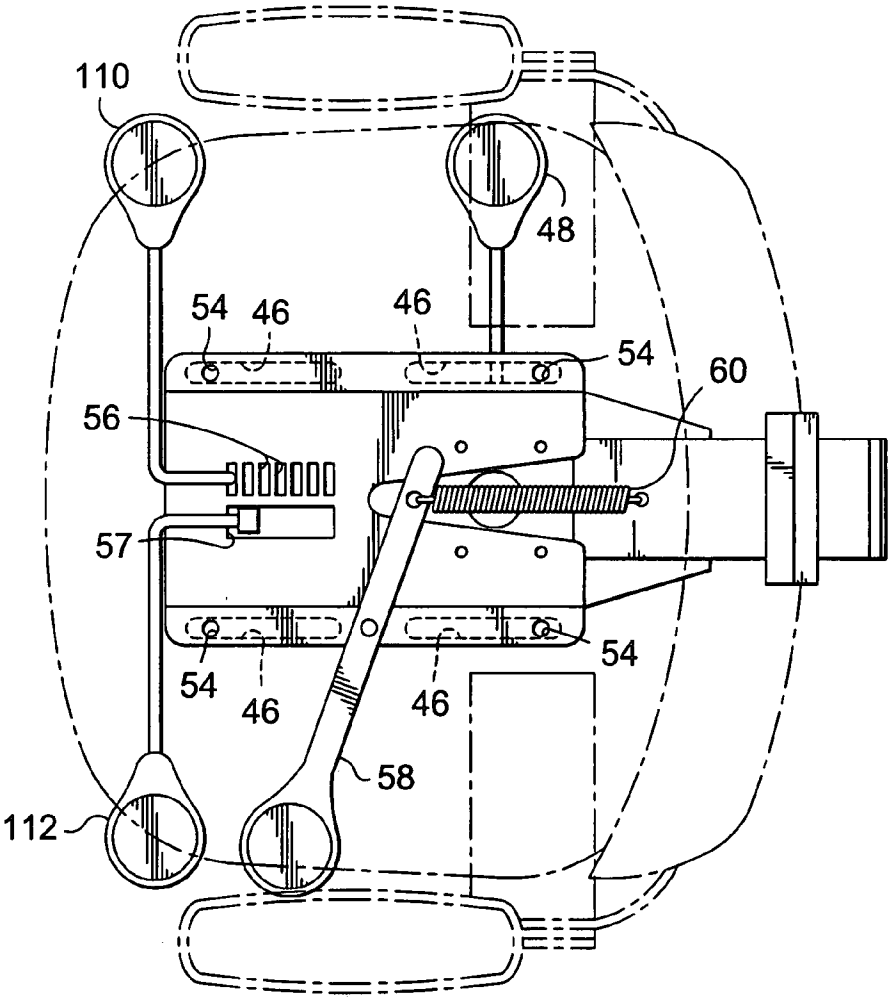
FIG. 5 is a top, cross-sectional view taken along line 5—5 of FIG. 3.

Chassis 22 is preferably a stamped or cast metal piece and includes a body 40 and a pair of flanges 42 that extend outwardly from body 40. As can best be seen in FIG. 2, the upper surface of flanges 42 forms a plane that inclines slightly upwardly from the rear of the chair to the front of the chair, the importance of which is described below. Each flange 42 includes a pair of elongated slots 46 that extend generally from the rear of the chassis toward the front of the chassis. Body 40 also includes a rear mounting section 44 that is used to mount J-back support bar 34 to the chassis 22. As best seen in FIG. 5, a height-adjusting lever 48 extends through chassis 22 and has an end that operably engages cylinder 20 in adjusting the chair height, as is known to those of skill in the art. While not shown, a cable-operated mechanism is a suitable substitute for lever 48.

As described generally above, seat plate 32 is slidingly coupled to chassis 22. Seat plate 32 is also preferably a stamped or cast metal piece. The seat plate has a central section 50 and a pair of extending flanges 52. Seat plate 32 is sized such that flanges 52 extend generally above and in-line with flanges 42 on the chassis. It should be noted that either flanges 42 or flanges 52 or both may have the slope from the rear to the front. Each flange 52 has a pair of threaded mounting holes 54. Generally, one mounting hole 54 is located near the rear edge of flange 52 and the other hole 54 is located near the forward edge of flange 52. The central section 50 of the seat plate is generally sloped downwardly from the front of the seat plate to the rear. This sloping central section 50 may optionally be provided with a series of slots 56 spaced from the front of the central section toward the rear. The slots 56 provide one component of a tilt-locking mechanism, as is further described below. Another elongated slot 57 is optionally included that provides one component of a tilt-limiter. Additionally, as best seen in FIGS. 4 and 5, a pivot connection optionally couples a tension lever 58 to seat plate 32. Tension lever 58 has an end that extends into the central section 50 of seat plate 32. A hole in the end of tension lever 58 couples a spring 60 to lever 58. The other end of spring 60 is coupled to a fixed point on the chassis 22 or J-back support bar 34. In use, lever 58 pivots and locks in place, using any suitable locking mechanism, to change the tension existing within spring 60. Although lever 58 and spring 60 are shown in the drawings, they are not always needed. The spring 60 merely provides additional biasing force to return the chair to the upright position. However, as is described below, the incline of flanges 42 on chassis 22 is, in most cases, sufficient to return the chair to the upright position.

A coupling assembly attaches seat plate 32 to chassis 22. The coupling assembly includes washers 62, bushings 64 and screws 66. Washers 62 are placed between flanges 52 and 42, and bushings 64 are located within slots 46. Thereafter, screws 66 are placed through the bushings 64 and the washers 62 and threaded into mounting holes 54 on flanges 52. Preferably, washers 62 and bushings 64 are made from a material that will facilitate the relative sliding movement between seat plate 32 and chassis 22. One such acceptable material is acetal. Other suitable materials that facilitate the sliding movement while resisting wear could, of course, be used. As can be understood, seat plate 32 is thus able to move relative to chassis 22. As the seat plate 22 moves forwardly relative to the chassis 22, the washers 62 and bushings 64 move along slots 46. The length of slots 46 determine the range of motion of the seat plate 32 relative to the chassis 22. It should also be understood that other bearing arrangements may be used and are within the scope of the present invention. Additionally, seat plate 32 is fixedly coupled to the seat 24 so that as seat plate 32 moves, seat 24 moves correspondingly.

Returning to FIG. 4, attention is directed to the armrest construction. Each armrest 26 includes a lower arm 38; each bent into a general L-shape. Each arm 38 has a lower portion that has at least one mounting hole 70. Similarly, each arm 38 has an upper portion that has at least one mounting hole 72. The lower end of each arm 38 is secured to either the seat plate 32 or directly to the seat 24. In such an embodiment, the armrests 26 travel with the seat. An alternative embodiment can also be used in which the armrests 26 are fixed relative to the seat 24. A nut-and-bolt-type arrangement fixedly couples the upper end of each arm 38 to a padded armrest extension 74. More specifically, each extension 74 has a padded portion 76 and a mounting bracket 78. The mounting bracket 78 has a square keyhole 80 near its lower edge. A keyed bolt 82 extends through the keyhole 80. Each bolt 82 has a square collar 84 and a threaded section 86 extending from the collar. The collar 84 is placed in mating relationship with square keyhole 80 so that extensions 74 do not rotate relative to bolts 82. The threaded end 86 couples the armrests 26 to the back bracket 36, as is described below.

The back bracket 36 then extends between the armrests 26. More specifically, back bracket 36 has a generally u-shaped bridge section 88 that spans the width of the chair back 28. The ends of bridge section 88 extend towards the front of chair 10 and terminate proximate the upper end of each arm 38. Each terminal end of bridge section 88 has a mounting hole 90. To couple back bracket 36 to arms 38, the bolt 82 is placed through keyhole 80 and the upper hole 72. A friction-reducing bushing 92 is placed in hole 90 and the bolt 82 is passed through the bushing. A nut 94 is used to maintain bolt 82 in place. In this coupling, back bracket 36 can rotate about bolt 82, the importance of which is described later. Preferably, the pivot point established by bolt 82 and back bracket 36 is located in the area corresponding to a properly seated occupant's hip joint.

Continuing with the description of back bracket 36, a weldment couples a guide plate 96 to bridge section 88 along the upper edge of the bridge. The guide plate 96 is centrally disposed between the two ends of the bridge section. While described as a separate welded piece, the guide plate 96 could also be formed integrally with the bridge section 88. Additionally, other forms of attachment beyond welding could be used. Guide plate 96 has a mounting plate 98 that in turn has a series of mounting holes 100 therein. The mounting holes 100 are used to secure guide plate 96, and thus back bracket 36, to the chair back 28. Any suitable attaching mechanism could be used, such as screws, bolts or the like. Guide plate 96 further has a pair of outwardly extending, slotted guide rails 102. Each rail 102 has an elongated slot 104 that is oriented generally vertically with respect to the chair.

Guide plate 96 couples back bracket 36 to J-back support bar 34 in a sliding manner. More specifically, the upper end of the bar 34 has an attached axle 106, the ends of which extend outwardly from the bar. Axle 106 can be a single piece coupled to the end of the bar 34 or can be two separate pieces, one of which extends from one side of the bar and the other of which extends from the other side of the bar. A portion of a friction-reducing bushing 108 is placed within each slot 104 and the end of the axle 106 is then placed through the bushing 108. In this coupling, the back bracket 36 slides with respect to the upper end of the J-back support bar 34, guided by the slots 104. The other end of the J-back support bar 34 is coupled at its lower end to the rear mounting section 44 of the chassis 22. This is a fixed coupling, such as by bolting, welding and the like.

As noted above, the mechanism 30 may optionally include a tilt locking device. This device is use to lock the chair in position at the existing state of recline. The slots 56 on seat plate 32 are one component of a tilt locking device. As best seen in FIG. 5, a lever-and-pawl combination 110 is another component of the tilt locking device. The lever-and-pawl combination 110 is coupled to the chassis 22. In use, the lever is operable to engage the pawl with a selected one of the slots 56 to lock the seat in place, and thus the back. Additionally, the mechanism 30 may optionally include a tilt-limiter device. This device is used to prevent the chair from returning to a fully-erect posture and stops the chair on return in a more-neutral position. The tilt-limiter includes a lever-and-pawl combination 112 that is coupled to the chassis 22. In use, the lever is operable to engage the pawl with the slot 57 to prevent the chair from returning to the fully-erect position.

Figure 3:
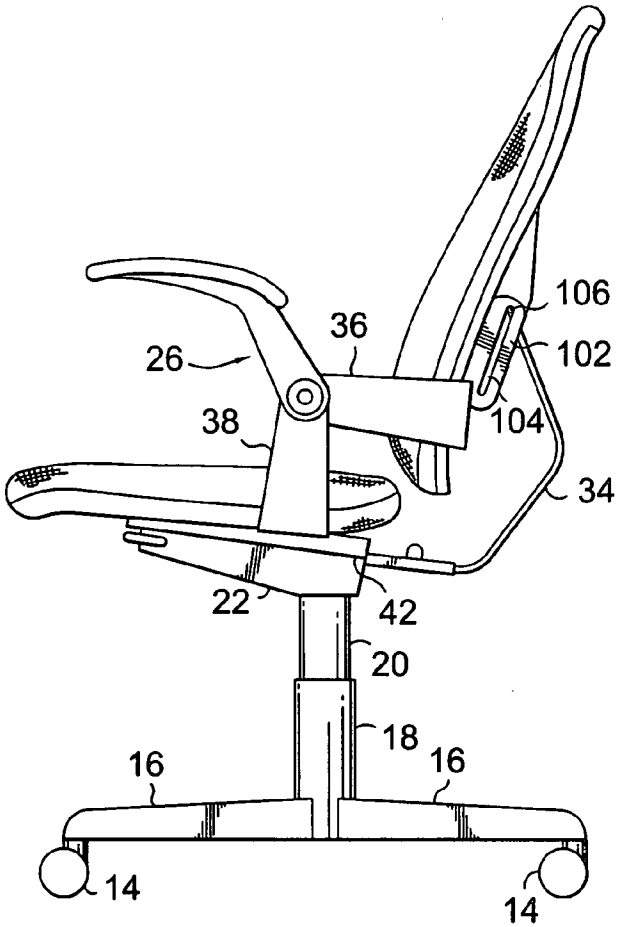
FIG. 3 is a view similar to FIG. 3, with the chair shown in the reclined position.

The operation of mechanism 30 on a chair 10 is best described with reference to FIGS. 2 and 3. FIG. 2 shows the chair in an upright position. FIG. 3 shows the chair in a reclined position. In use, if the occupant desires to move from the upright to the recline position, the occupant will impart a reclining force on the chair back. In other words, the occupant will lean back. When the occupant leans back, several things happen at once. First, the chair back 28 slides downwardly and rotates, as shown in FIG. 4. The downward motion of the chair back 28 is guided by guide plate 96. More specifically, the axle 106 and bushings slide upwardly through slots 104 and the entire back bracket 36 rotates with respect to the axle 106. The back bracket 36 pivots about bolts 82. Again, bolts 82 are positioned near the hip joint of the occupant. This pivoting action thus approximates the pivoting of the occupant's back with respect to the occupant's legs.

Second, as the back bracket 36 moves, the motion is transmitted into the arms 38, forcing the arms forwardly. As the arms move forwardly, the seat plate 32 also moves forwardly. Because either the flanges 42 or 52, or both are inclined upwardly, the seat also moves slightly upwardly. As the occupant reclines, the seat moves forwardly to maintain the occupant's center of gravity generally over the column 18, thus increasing the stability of the chair. Moreover, as the occupant reclines, the lower back or "lumbar" area of the chair back follows the motion of the occupant's back. The slots 104 in guide plate 96 and the connection of the components described above achieve this guiding action. This motion reduces any bridging effect. As the chair back closely follows the movement of the occupant's back, the shirt pull effect is also reduced. Because the flanges 42 and 52 are inclined, if the occupant wants to return to the upright position, the occupant merely sits up. As the force is relieved from the chair back, the force of gravity returns the seat 24 down the incline formed by the flanges 42 and 52. If the spring 60 is used, the spring force assists the return action.

If the arms are not coupled to the seat plate 32, but are instead coupled to the chassis 22, they will not move as the occupant reclines. If this construction is used, the seat 24 still moves forwardly as the occupant reclines. In effect, the chair back and the motion of the occupant move the seat forwardly and upwardly as described above.

It can be seen, therefore, that the construction provides a simple chair mechanism that is easily manufactured and that provides an occupant many advantages. Shirt pull and bridging are reduced as the chair back closely follows the back of the occupant, pivoting at roughly the hip joint of the occupant. The occupant's center of gravity is maintained over the column 18 during recline so that a smaller base assembly 12 can be used. Moreover, as the seat slides forwardly, the occupant's eyes are maintained in generally the same viewing position in both the upright and reclined positions. The incline of the flanges 42 and 52 allows the mechanism to be used by a wide range of occupants without any additional spring force needed. If an adjustable spring 60 is used, a much smaller spring is necessary so that the occupant more easily adjusts it. An additional benefit provided by the inclined flanges is the dwell force is roughly balanced by the weight of the occupant's upper body from the outset so that an occupant can remain reclined with very little effort.

The present invention has been described in relation to particular embodiments, which are intended in all respects to be illustrative rather than restrictive. Alternative embodiments will become apparent to those skilled in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated and with the scope of the claims.

What is claimed is:

1. A back bracket for use in a chair mechanism, comprising:

a U-shaped member having a central section and a pair of ends, each end having a pivot point extending therethrough, wherein the U-shaped member is adapted to pivot only about the pivot points; and a guide plate coupled to the central section, the guide plate having a mounting section adapted to be mounted to a chair and having a wall with at least one guide slot having a defined closed perimeter.

2. The back bracket of claim 1, wherein the guide plate has a pair of walls, each including a guide slot having a defined closed perimeter.

3. The back bracket of claim 2, wherein the guide slots extend in a direction perpendicular to the U-shaped member.

4. The back bracket of claim 3, wherein the guide plate is fixedly coupled to the U-shaped member.

5. The back bracket of claim 4, further comprising:

a back support bar having first and second ends, the support bar adapted to be coupled on the first end to a chair and on the second end to the guide slot of the guide plate.

* * * * *